US009874007B2

(12) United States Patent
Malitskiy et al.

(10) Patent No.: US 9,874,007 B2
(45) Date of Patent: Jan. 23, 2018

(54) TRANSFORMABLE PLATFORM

(71) Applicant: Galina Ivanovna Belykh, Moscow (RU)

(72) Inventors: Grigory Alexandrovich Malitskiy, Moscow (RU); Maria Evgenievna Malitskaya, Moscow (RU)

(73) Assignee: Galina Ivanovna Belykh, Moscow (RU)

( * ) Notice: Subject to any disclaimer, the term of this patent is extended or adjusted under 35 U.S.C. 154(b) by 0 days.

(21) Appl. No.: 14/655,758

(22) PCT Filed: Nov. 26, 2013

(86) PCT No.: PCT/RU2013/001065

§ 371 (c)(1),
(2) Date: Jun. 26, 2015

(87) PCT Pub. No.: WO2014/104931

PCT Pub. Date: Jul. 3, 2014

(65) Prior Publication Data

US 2015/0322667 A1 Nov. 12, 2015

(30) Foreign Application Priority Data

Dec. 28, 2012 (RU) ..... 2012157665

(51) Int. Cl.

| | |
|---|---|
| ***E04H 3/26*** | (2006.01) |
| ***E04B 1/343*** | (2006.01) |
| ***E04H 3/12*** | (2006.01) |
| ***E04H 3/30*** | (2006.01) |
| ***A63J 5/00*** | (2006.01) |

(52) U.S. Cl.

CPC ..... *E04B 1/34305* (2013.01); *A63J 5/00* (2013.01); *E04B 1/34357* (2013.01); *E04H 3/12* (2013.01); *E04H 3/26* (2013.01); *E04H 3/30* (2013.01); *E04B 2001/34394* (2013.01)

(58) Field of Classification Search

CPC ..... E04H 3/26; A63J 5/12; E04B 1/34305; E04B 1/34357; E04B 2001/34394

See application file for complete search history.

(56) References Cited

U.S. PATENT DOCUMENTS 3,812,631 A * 5/1974 Cruse ..... E04H 3/26 52/1
3,918,225 A * 11/1975 Fisher ..... E04H 3/26 52/115
4,633,625 A * 1/1987 Dieban ..... E04H 3/26 108/91

(Continued)

*Primary Examiner* — Brian Mattei
*Assistant Examiner* — Gisele Ford
(74) *Attorney, Agent, or Firm* — Bardmesser Law Group

(57) ABSTRACT

The invention relates to the field of satisfaction of vital human needs. A transformable platform, which is intended for creation of installations arranged both horizontally and vertically or slantwise, represents the unidirectionally oriented rod-shaped elements with a flat end face each, located close to each other in the form of cells, which form the flat horizontal platform in the initial position due to the flat end faces located at the same level. Each rod-shaped element is equipped with an individual drive to move linearly and lift the flat end face above the level of the surface of the transformable platform or lower the flat end face below this level.

17 Claims, 13 Drawing Sheets

(56) References Cited

U.S. PATENT DOCUMENTS

| | | | | | |
|---|---|---|---|---|---|
| 4,735,024 | A * | 4/1988 | Rosato | E04H 3/26 | 52/126.6 |
| 5,103,600 | A * | 4/1992 | Geiger | E04H 3/26 | 52/126.5 |
| 5,319,895 | A * | 6/1994 | Ray | E04H 3/26 | 472/92 |
| 5,468,190 | A * | 11/1995 | McCaffrey | E04H 3/26 | 472/82 |
| 5,689,917 | A * | 11/1997 | St-Germain | E04H 3/26 | 52/10 |
| 5,802,773 | A * | 9/1998 | Pingel | E04H 3/26 | 52/10 |
| 2007/0244610 | A1* | 10/2007 | Ozick | A47L 5/30 | 701/23 |
| 2008/0163560 | A1* | 7/2008 | Churchward | E04H 3/22 | 52/10 |
| 2011/0088975 | A1* | 4/2011 | Ghorbani | E04H 3/26 | 182/141 |
| 2011/0203147 | A1* | 8/2011 | Van Herpen | F21V 33/006 | 40/541 |
| 2012/0272584 | A1* | 11/2012 | Bilsen | E04H 3/28 | 52/7 |

* cited by examiner

TRANSFORMABLE PLATFORM

CROSS-REFERENCE TO RELATED APPLICATIONS

This application is a US National Phase of PCT/RU2013/001065, filed on Nov. 26, 2013, which claims priority to Russian Patent Application No. 2012157665, filed on Dec. 28, 2012.

BACKGROUND OF THE INVENTION

Technical Field

The invention relates to the field of satisfaction of vital human needs and may be used to equip the buildings and constructions used as a temporary place for the public accommodation during mass entertainment, sports, cultural, political and similar events. The invention relates to the field of construction, and more particularly to transformable spatial structures that may be used as walls or floor, or ceiling in the rooms subject to internal rebuilding, as well as in the public open space.

Description of the Related Art

Nowadays the old solutions involving demolition or dismantling of partitions and rearrangement in accordance with the new layout plans are used for spatial transformation of interior layout of the rooms subject to internal rebuilding. Other equipment associated with the layout (tables, chairs, etc.) and necessary for life-sustaining activity of the room users, is generally transferred to the warehouse and then placed in the zones in accordance with the plan of fitting to each section in the room. The same applies to the creation of platforms, podiums, stages, which are used for the event, but will be dismantled in the future. All these solutions are time consuming, and sometimes the dismantled equipment does not fit in the new layout. Furthermore, the constructed installations in the layout are permanently installed and may not be changed during the event. For example, the podium, which represents a platform above the floor, is arranged for fashion show held indoors. After the platform is installed, it may not be changed in the steady state.

A telescopic bleacher, which consists of a multisection metal frame functioning on the principle of telescopic guiding rails, which are pulled out from each other, when setting to the working position, and pushed into each other, when prepared for storage, with wheels embedded into the frame base enabling moving of each section on the floor, a fiberglass monolith fixed on the frame that includes a stairway with steps between the rows formed in the monolith, a backplate for legs and seats, and side and rear fence gratings fixed on the frame (RU 56438, E04H3/12, published on Sep. 10, 2006), is an example of possible transformation of the platforms for the audience.

Using the telescopic bleacher as a transformable platform enables to get two kinds of installations: an audience hall, when the seats are pulled out from the niches along the guiding rails, and free platforms that may be used for other purposes, as the seats previously located on these platforms are pushed into the niches (Sliding (telescopic) bleachers for the audience of "Congress" series, Internet address: http://www.rasport.ru/tribune.html; Sliding telescopic bleachers for the audience, Internet address: http:**www.sportcomplect.ru/catologue/tribune/telescopic_tribunes).

Such design approach is very restrictive and does not allow for expansion of possible installation variations.

These examples are provided for the art description and are not prototypes of the claimed subject matter. The prototype of the claimed subject matter is not found.

SUMMARY OF THE INVENTION

The present invention is aimed at achievement of the technical result involving provision of a transformable platform to reduce the terms for creation of a three-dimensional installation in the buildings intended for frequent change of the interior layout, as well as in public open spaces.

The specified technical result is achieved due to the fact that the transformable platform for installations represents unidirectionally oriented rod-shaped elements of different sections (square, circle, triangle, prism, etc.) with the end faces located close to each other in the form of cells, which form the flat platform in the initial position due to the end faces located at the same level. Moreover, each element is equipped with an individual drive to move vertically, lift the end face above the flat platform level or lower the end face below this level. If necessary, the platform may form not only a plane, but a three-dimensional arrangement in the initial position.

The specified features are essential and interconnected to form a stable combination of essential features sufficient to achieve the required technical result.

Additional features and advantages of the invention will be set forth in the description that follows. Yet further features and advantages will be apparent to a person skilled in the art based on the description set forth herein or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

Figure 3:
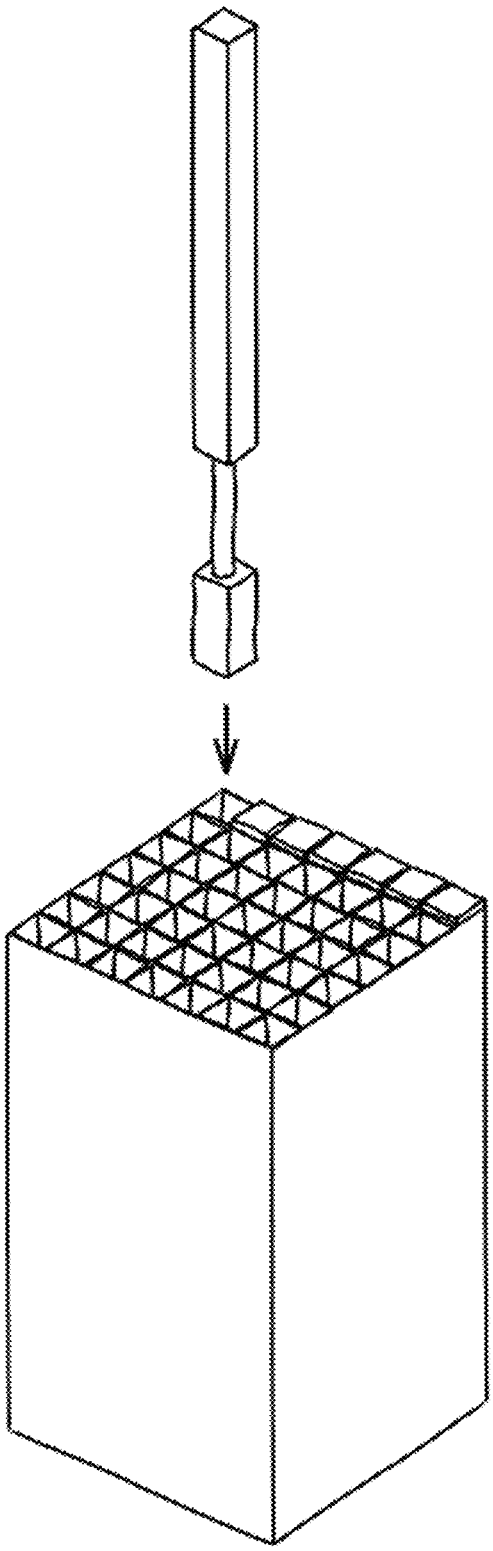
Figure 4:
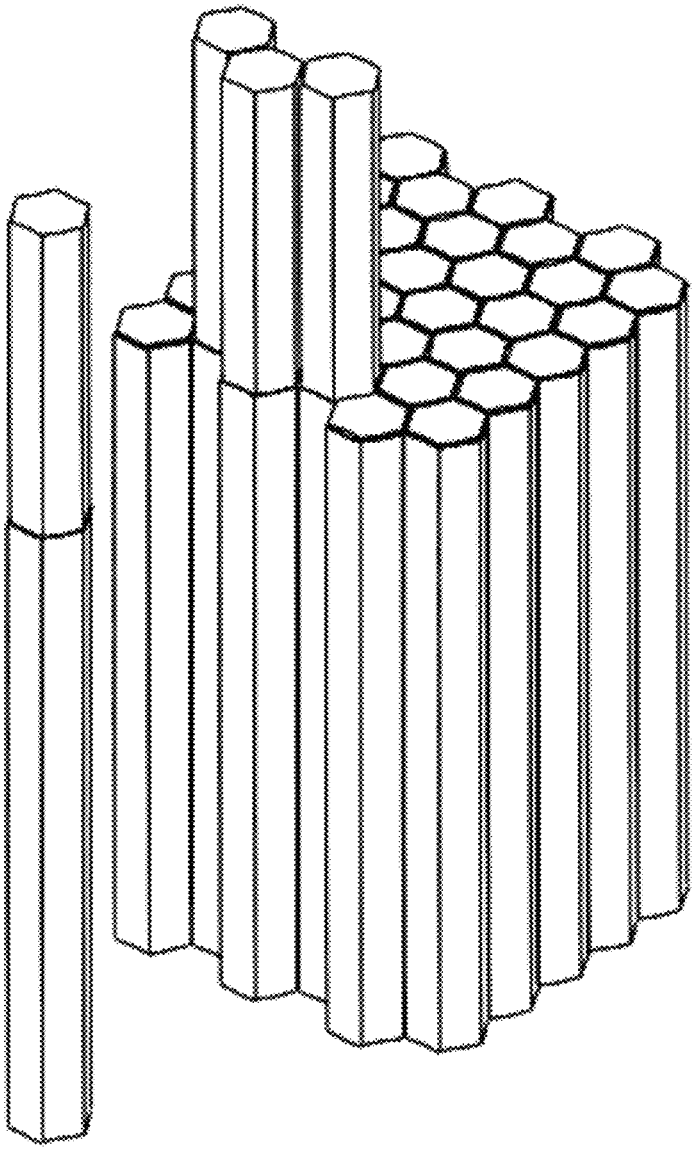
Figure 5:
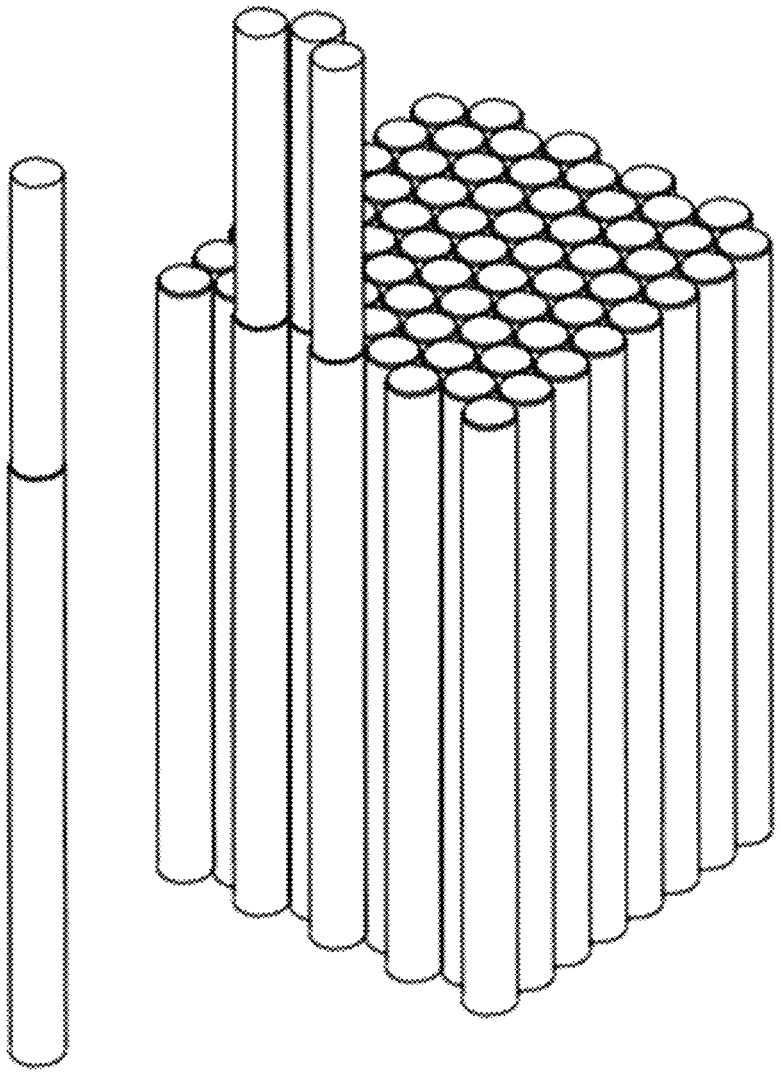
Figure 7:
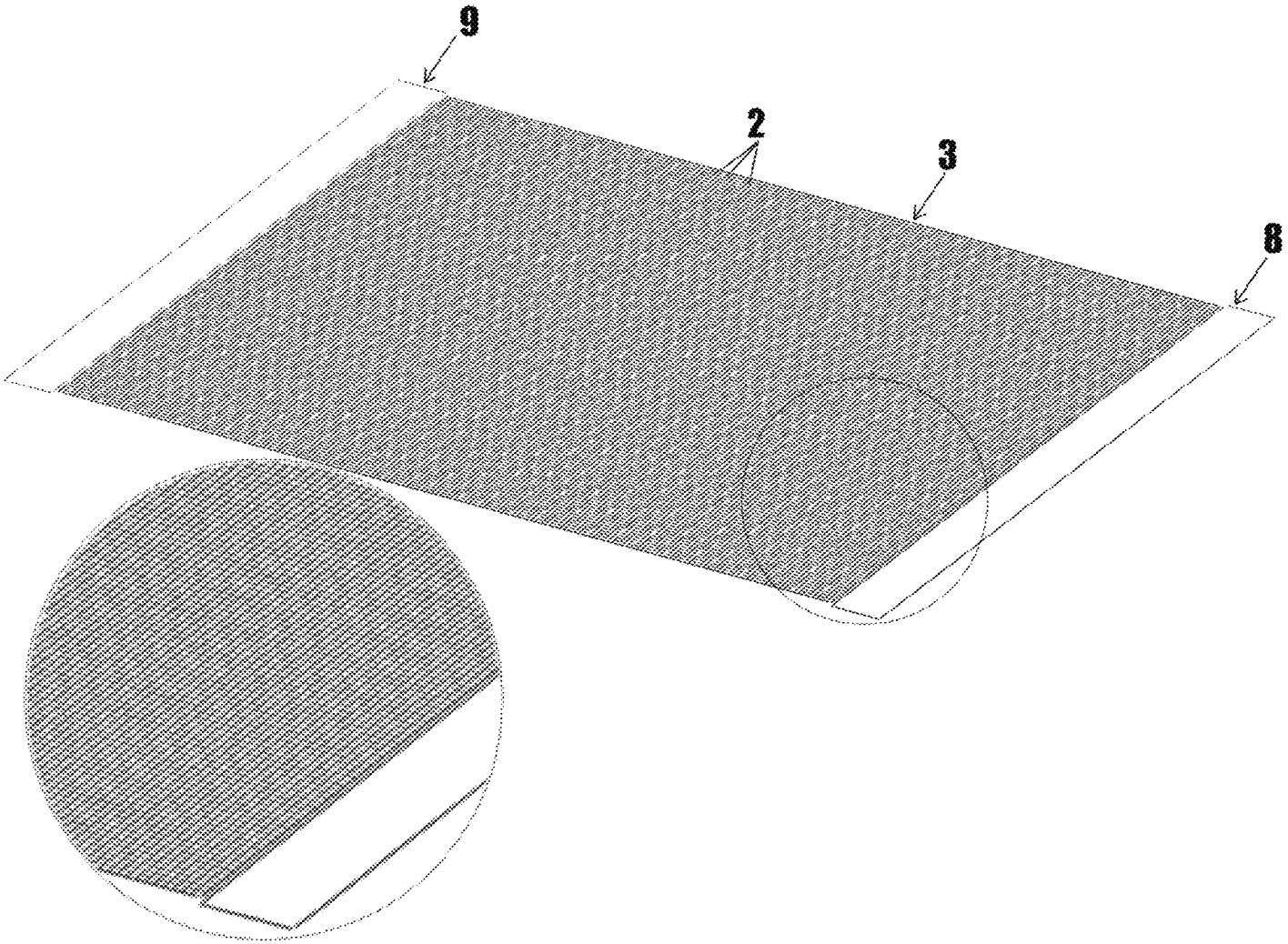
Figure 6:
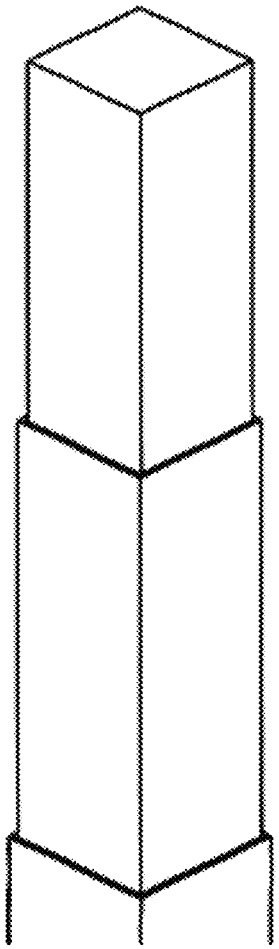
Figure 8:
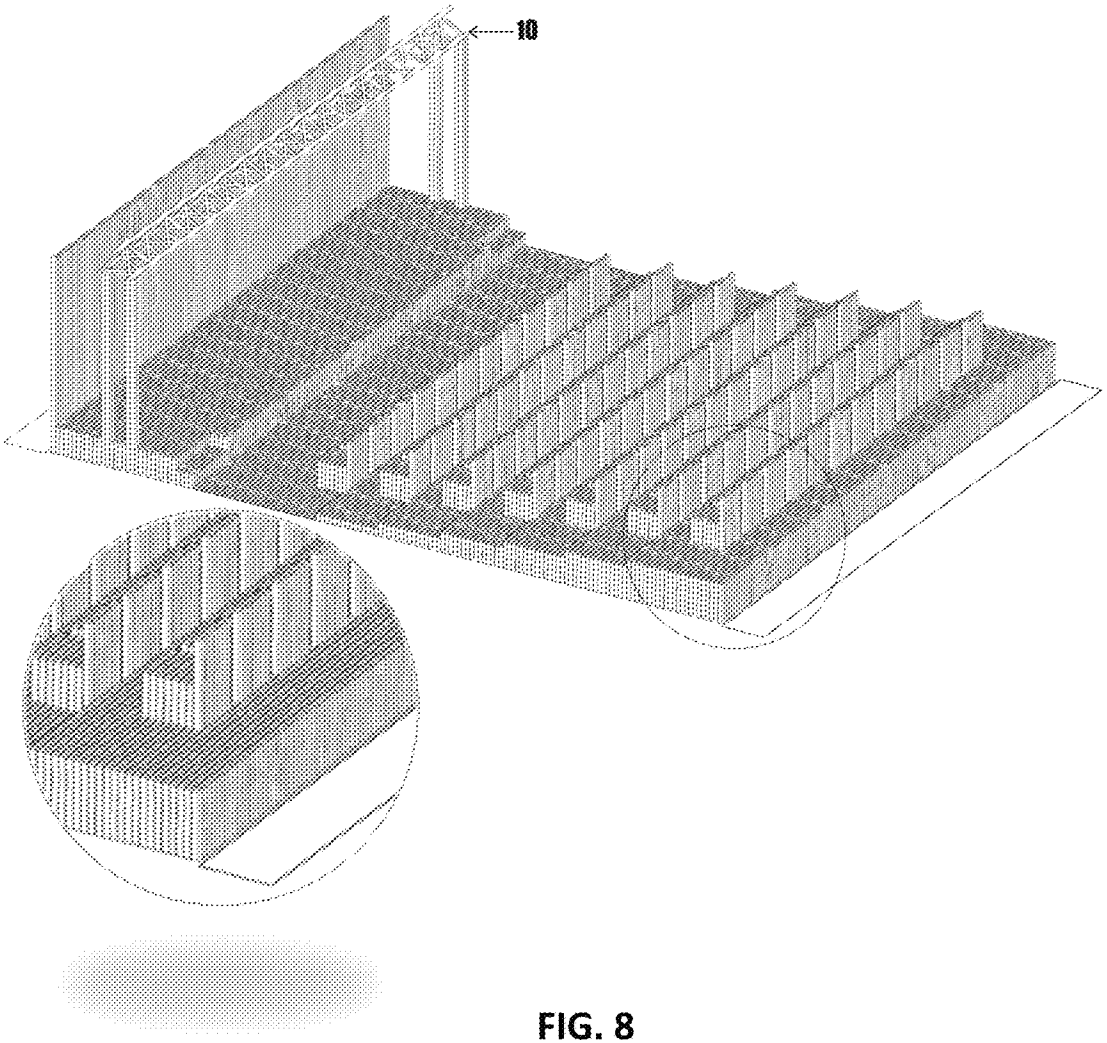
Figure 9:
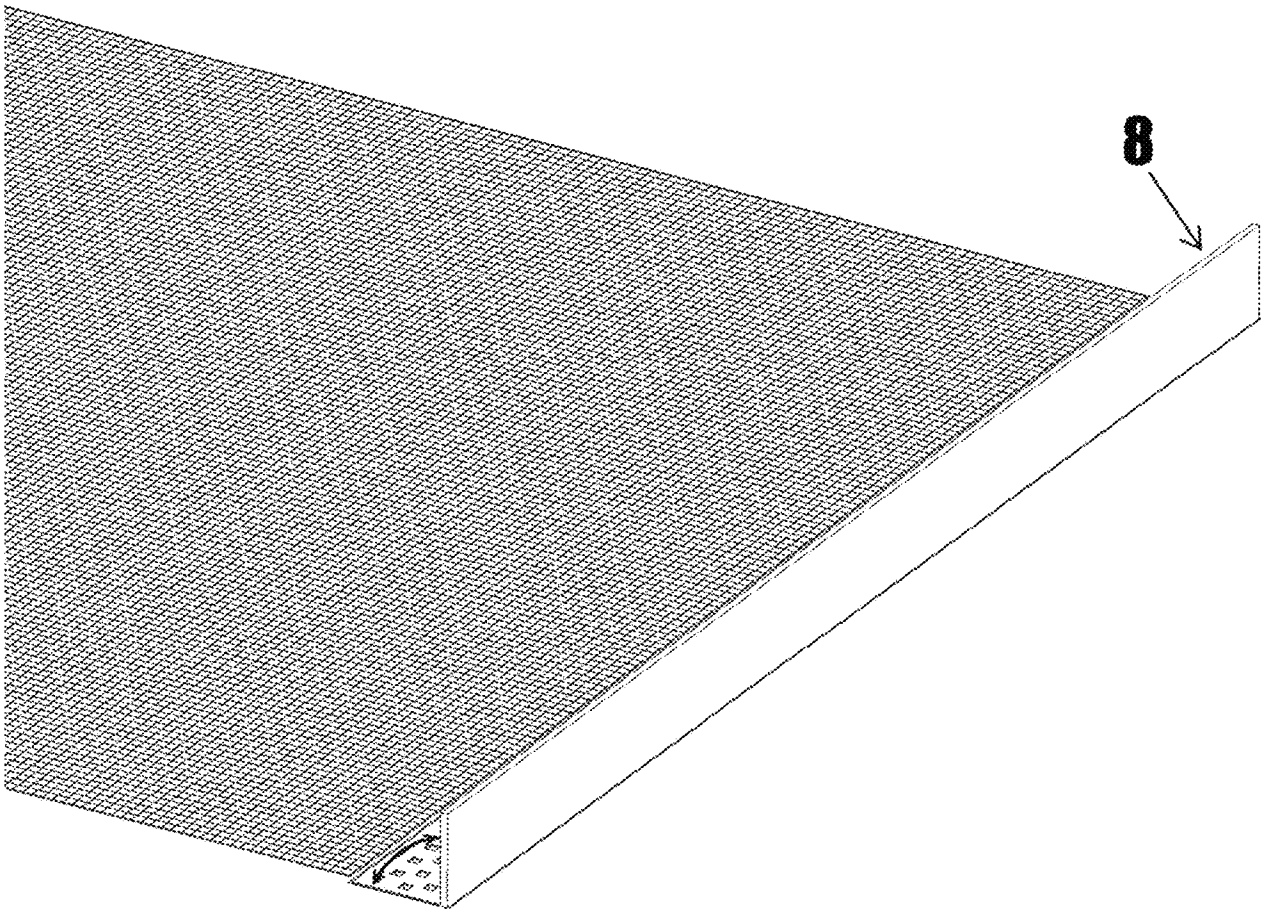
Figure 10:
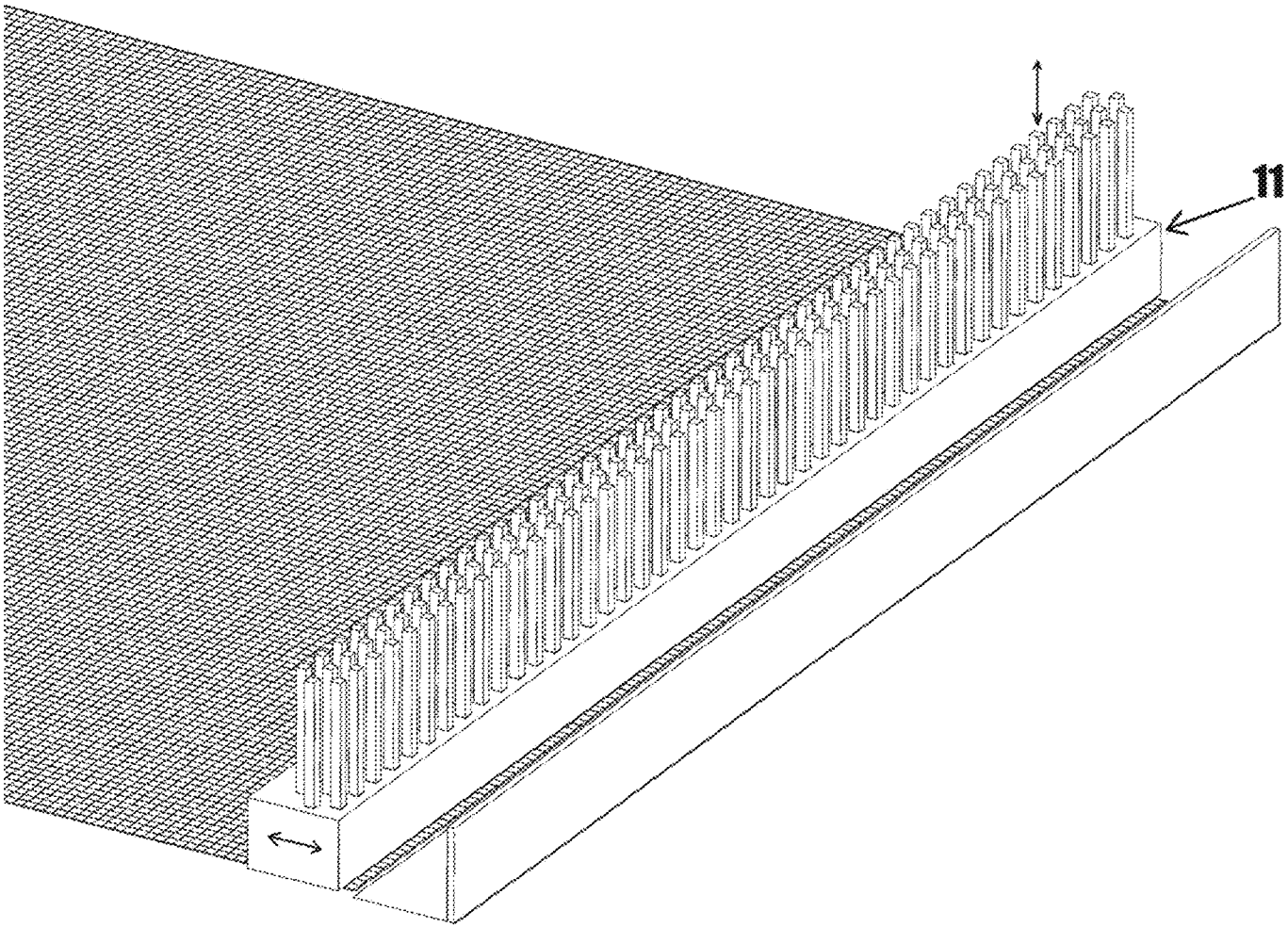
Figure 11:
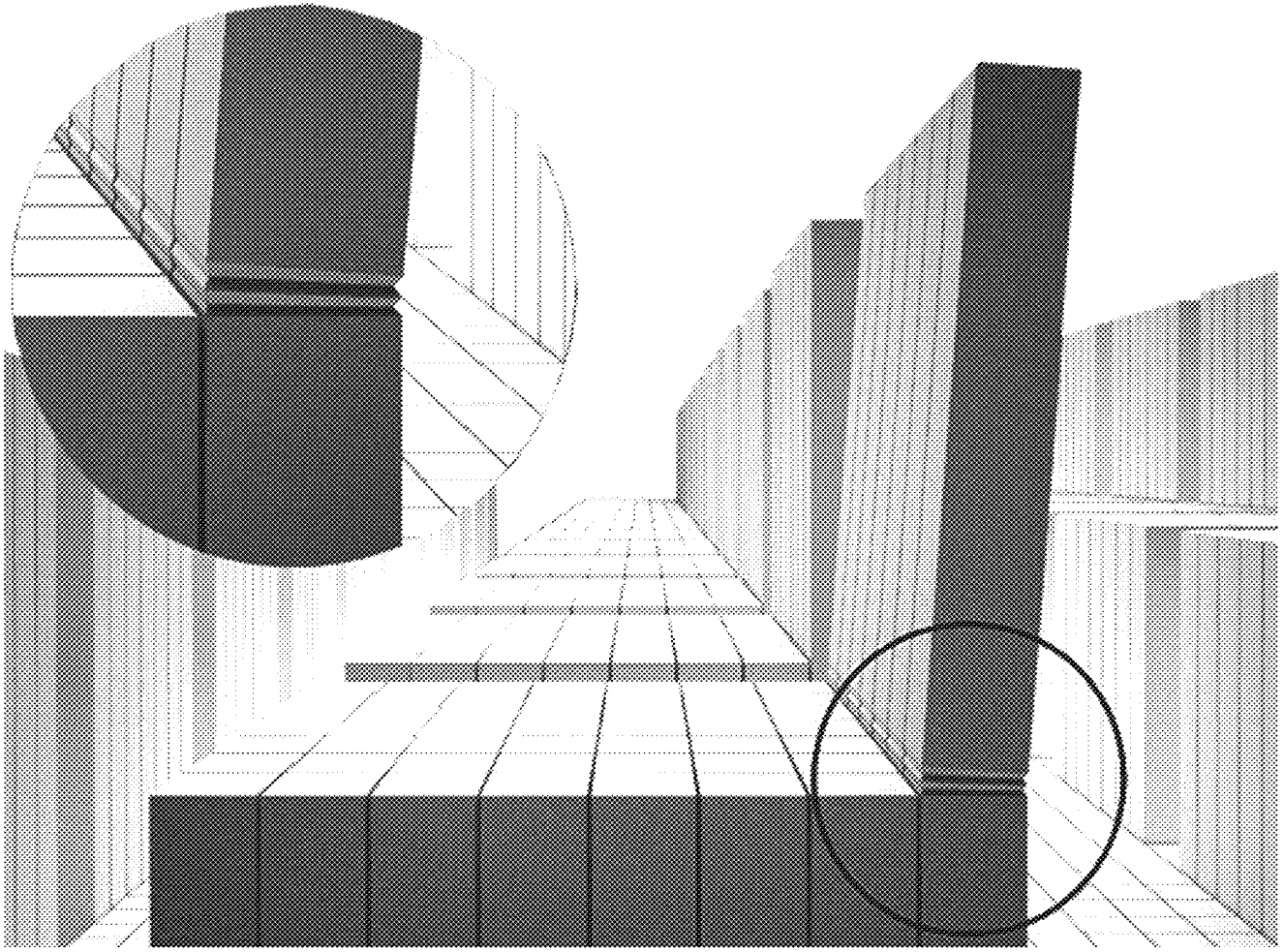

FIG. 3 displays an enlarged cassette module of the platform, in which the telescopic rods are mounted;

FIG. 4 is one of the possible embodiments of the cell-shaped telescopic rod section;

FIG. 5 is one of the possible embodiments of the circle-shaped telescopic rod section;

FIG. 6 depicts a rod with two elongation degrees;

FIG. 7 is one of the possible embodiments of the full-size transformed platform in the initial condition;

FIG. 8 is an example of an installation on the transformed platform;

FIG. 9 illustrates the platform with the opened hatch of a washing beam;

FIG. 10 depicts the platform washing process;

FIG. 11 is an example of embodiment of rods with joint elements.

Figure 12A:
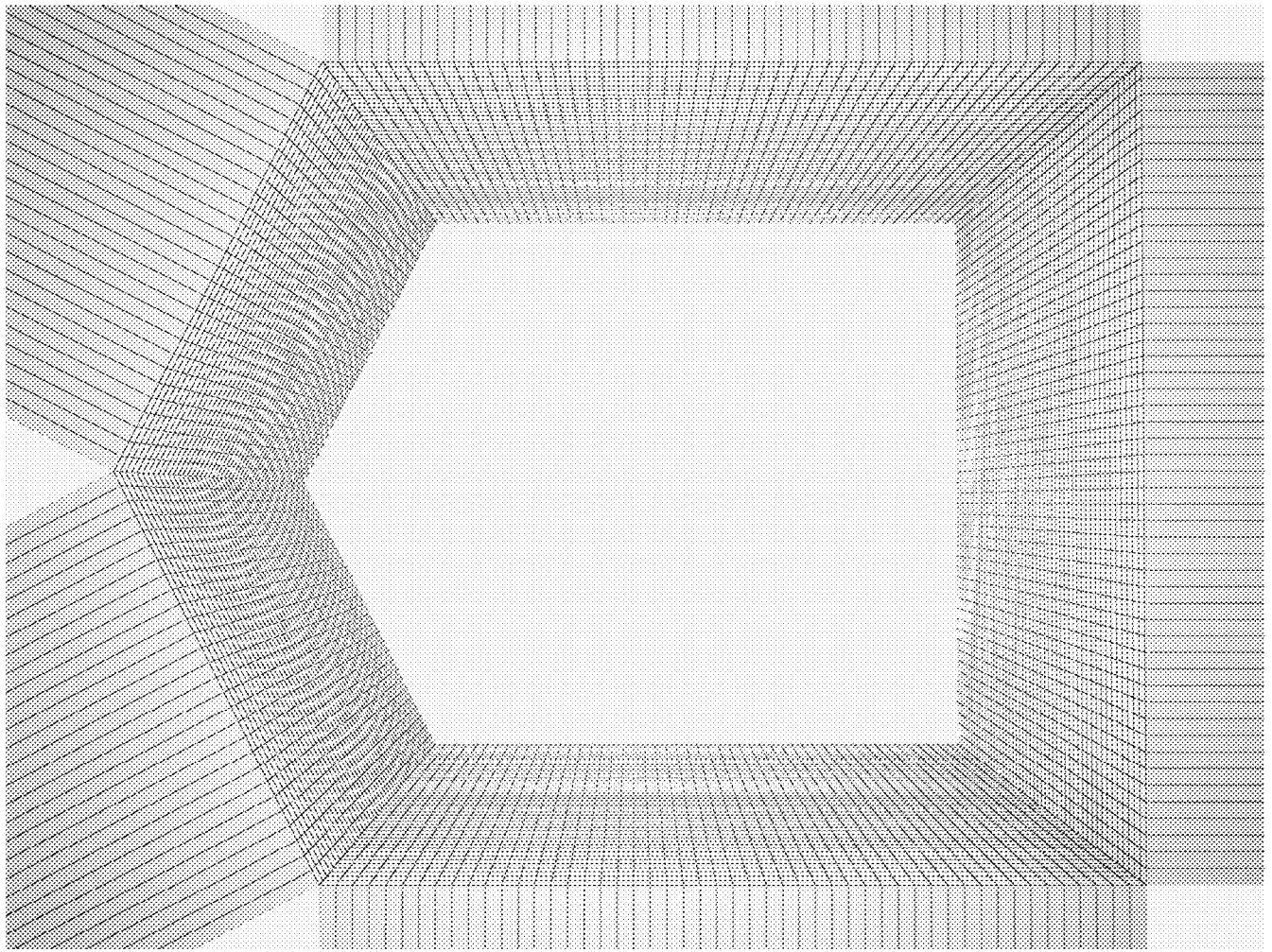
Figure 12B:
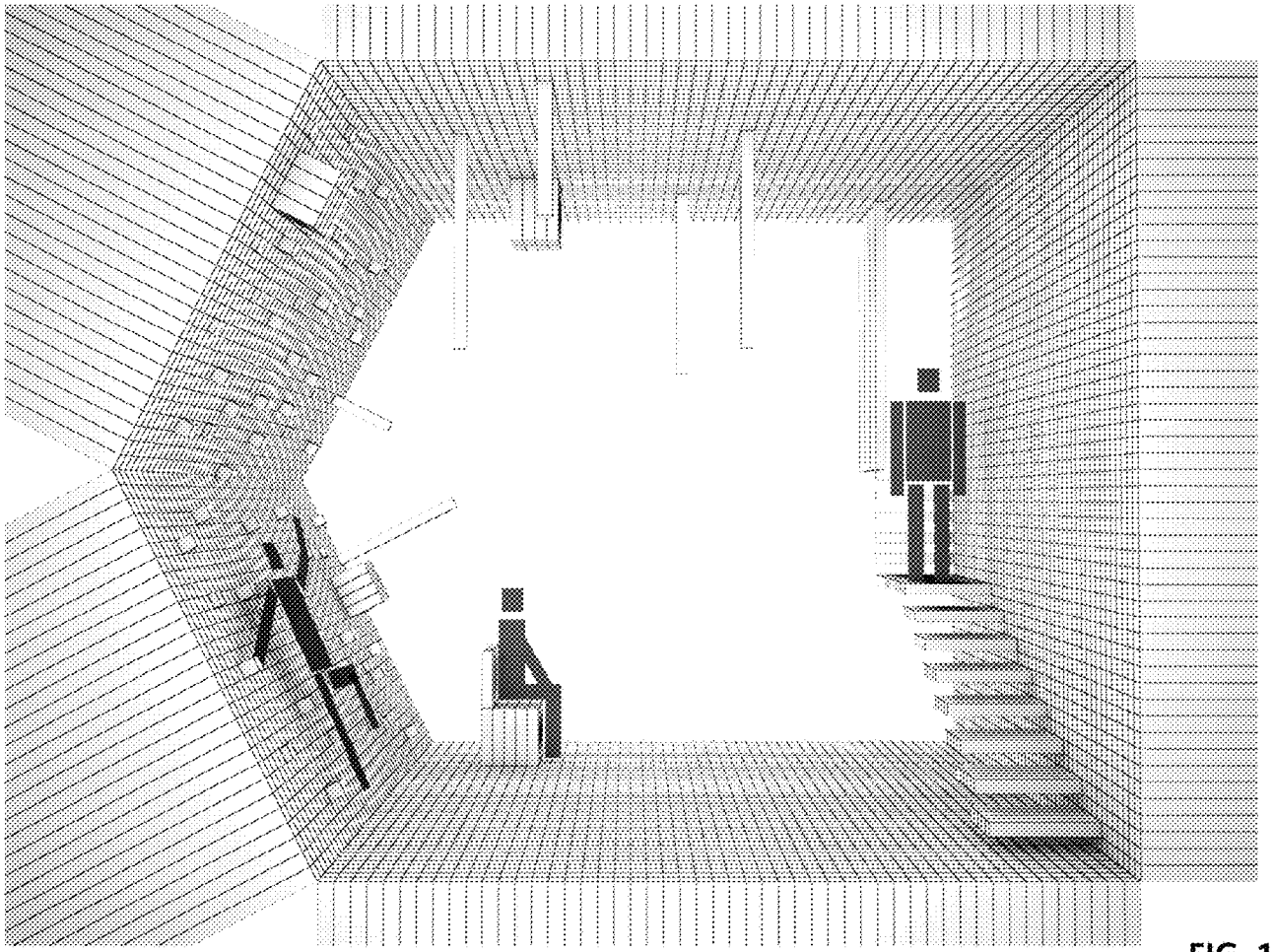

FIGS. 12A, 12B illustrate arrangements of the elements to create vertical or angled surfaces when needed.

DETAILED DESCRIPTION OF EMBODIMENTS OF THE INVENTION

Reference will now be made in detail to the embodiments of the present invention, examples of which are illustrated in the accompanying drawings.

According to the present invention, a transformable platform design, which is primarily intended for creation of the flat and three-dimensional installations in horizontal or vertical, or inclined position depending on the set application task, is considered.

A transformed platform (FIG. 1) represents the unidirectionally oriented rod-shaped elements 1 with an end face 2 each, located close to each other in the form of cells, which form the flat horizontal or angled or vertical platform 3 in the initial position due to the end faces 2 located at the same level. The description will be further given with respect to the horizontal platform 3, but it is also true for the case, where the platform is located vertically or slantwise, forming the floor, ceiling and walls, thereby forming the transformable rooms. In vertical position, for example, the platform can be used as a climbing wall. In fact, the elements 1 are the telescopic rods. The rods may adjoin to each other with minimum gap sufficient to enable one rod to move vertically and freely (without obstruction) relative to the adjacent rods, but they may also be located at some distance from each other. The position of the end faces of the rods determines the structure of the horizontal surface 3 with regard to its integrity. If the platform is used as a podium or stage with rods in the initial position in accordance with FIG. 1, the gaps between the adjacent rods shall be definitely minimized. In fact, the finish of the horizontal surface 3 of such platform will be the same as the tiled pavement finish.

Figure 2:
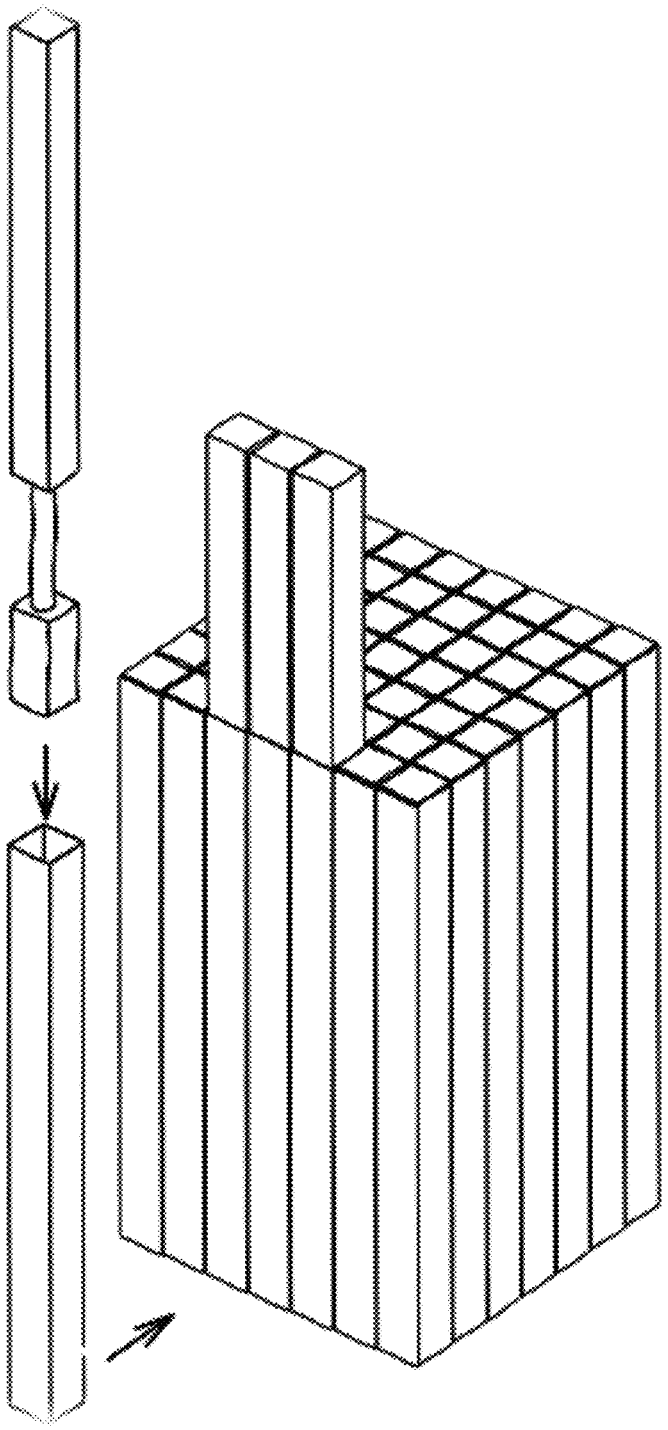
FIG. 2 depicts the single rod-shaped module and a part of the platform section.

The vertically-aligned elements (rods or poles) are mounted in a frame 4, which is a support for poles and forms the guiding rails enabling the poles to move vertically. The design of such frame or load-bearing frame is not disclosed in detail, since it is a conventional design assembly. Some examples are given in FIGS. 2 and 3. The frame may be individual for each rod or combine a group of rods under the cassette principle. The rod may have both one and several degrees of elongation (an example is given in FIG. 6). The telescopic rods may have different sections: square, rectangular, triangular, polygonal, round, oval, in the form of cells, puzzles, etc. (some examples are given in FIGS. 4, 5).

Figure 1:
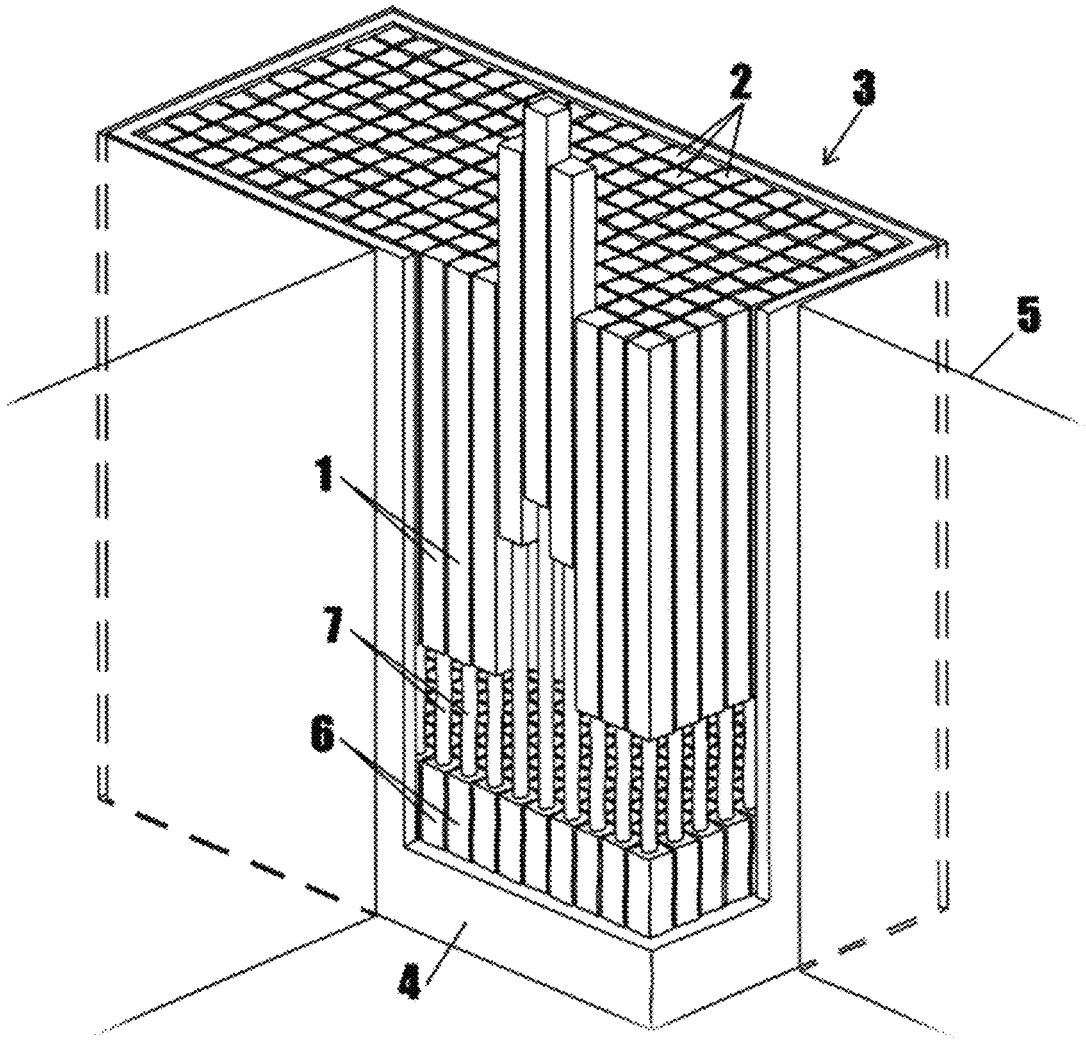
FIG. 1 shows a transformable platform in the initial position and pulled out unidirectionally oriented rod-shaped elements of different sections reproducing the form of regular prisms.

The transformable platform may be arranged directly on any substructure (surface) and embedded to the frame 4 level, on a level with a supporting surface 5, as shown in FIG. 1.

The end faces of unidirectionally oriented elements may be flat. The top of the elements 1 may not only have a flat shape, but also a slightly rounded one, or with a slight relief, or slightly convex, or concave, or any other shape of surface. The rods of various sections and sizes may be used in one platform. The side walls of the rods 1 and end faces 2 are possible to be used as a decoration or illumination elements by placing the LED screens along the height.

The rods in the pulled out section may have jointed elements providing inclination from a vertical position (FIG. 11) and, for example, bending of the chair backs or inclined walls. The platform shall be provided with an automatic cleanup (washing) system to clean the rod surfaces, when they are pulled out and embedded. The system, the design of which resembles a beam crane moving along the guiding rails laid along the platform edge, is used in this case. When inactive a washing beam 11 (FIG. 10) is located at the end of the platform under the hatch 9. Upon the system activation, the hatch is opened, the washing beam is pulled out of it and moves with the help of the guiding rails along the platform. The beam is provided with openings resembling the rod's form. At the moment when an opening is located exactly above the rod, the beam stops, and the rod is pulled out and passes through the openings in the washing beam, in which the rod is cleaned. After being fully pulled out, the rod moves in the opposite direction and returns to its initial position, after which the beam is shifted by one step, and the cycle is repeated.

Each element 1 in the transformable platform is provided with an individual drive 6 to enable vertical movement relative to the level of the flat horizontal surface: below or above the level of all rods (FIG. 1) being in the initial position. The extreme downward position is an optimum one for the rods: this is the initial position (in which all the end faces 2 are arranged in a common horizontal surface 3), all rods are supported by the frame, and the drive is unloaded in this position. When the drive is activated, the rod moves upward in the vertical direction, the drive 6 ensures holding the rod in the pulled-out position. The rod may have a telescopic design in the form of a support with a "screw-nut" pair, i.e. it may be comprised of two parts: 7 and 1, one of which (7) is a supporting part, and the other one (1) moves over the first one. However, the drivers, which enable the rods both to go up and down the initial position. In this case, the drive or an individual holding mechanism for each rod shall hold or fix the rod not only in the initial position, but also in the positions below or above the horizontal surface 3. The drive of each vertically-aligned element may be of the hydraulic, pneumatic, mechanical, electromechanical or any other possible type of drive. This example shows one of the possible drive embodiments, in practice, other types of assembly arrangements may be used depending on the purpose and load. Such drives are characterized by the fact that they are used individually for each element 1, and each drive is provided with a remote control system, with which it is controlled by a computer-assisted drive control, in which the drive control software algorithms are provided for the centralized vertical movement of the vertically-aligned elements, when creating the three-dimensional installations. Furthermore, the computer-assisted drive control shall be provided with a sensor feedback system. The sensors are the pole position indicators.

The examined multifunctional and multipurpose transformable platform is a matrix (cell-type) set of the vertically-aligned rods or elements in the form of elongated bodies provided with a heightwise position control feature. The end faces of all rods are located in the common horizontal plane and form the flat surface (FIG. 7) in the initial position. When sending the control signal or delivering the operating pressure, the poles go up above or down below the common horizontal plane and form the elements of object structure—walls, partitions, elevations, platforms, etc. (FIG. 8). It is possible to create any three-dimensional object structure in such platform according to the special control algorithm. The arranged structures may be fixed or mobile, i.e. they can change the form during some process conditioned upon the applied necessity or purpose of the structure arranged on the platform. Different structural elements, frameworks, coatings and various illumination frames 10 may also be installed on the telescopic rods, and they are mounted without a lifting mechanism, since they are fixed to the rods, when the platform is the initial position. These elements may be stored under the hatch 9 and move over the platform along the guiding rails, along which the washing beam moves. The outer contour of the platform may not only have a rectangular form, but also any arbitrary form. The rods may be located orderly or in a random way. Also, FIGS. 12A, 12B illustrate arrangememts of the elements of the elements to create vertical or angled surfaces when needed (with FIG. 12A showing an initial state, looking into a "playrooom" formed by the elements, and FIG. 12B showing a final state).

INDUSTRIAL APPLICABILITY

The present invention is industrially applicable and may be manufactured using the commonly used engineering and electronics technologies, as well as modern means and materials. The invention permits to transform the fixed multifunctional platform to the structure with a predetermined layout within a short period of time, which reduces the terms for installation of constructions intended for exhibitions, demonstrations, including fashion shows, conferences, sporting events, for example in the form of a climbing wall, Bicycle, Moto trial, etc.

Having thus described the different embodiments of a system and method, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. A transformable platform for creation of three-dimensional multi-functional installations, comprising:

a plurality of unidirectionally oriented rod-shaped elements;

each unidirectionally oriented rod-shaped element having an end face;

the unidirectionally oriented rod-shaped elements are arranged so that end faces of adjacent unidirectionally oriented rod-shaped elements form multiple tiers, wherein no unidirectionally oriented rod-shaped element belongs to more than one tier, and wherein each tier comprises multiple unidirectionally oriented rod-shaped elements;

wherein the tiers form flat horizontal or vertical surfaces or surfaces angled relative to a horizon, in their initial position due to the end faces of their unidirectionally oriented rod-shaped elements located at the same level;

wherein each unidirectionally oriented rod-shaped element is equipped with an individual drive for independent telescoping linear movement so as to extend or contract each unidirectionally oriented rod-shaped element independent of other unidirectionally oriented rod-shaped elements and to shape the platform into the multiple tiers, and wherein different tiers have end faces of their rod-shaped elements located at different levels.

2. The platform of claim 1, wherein the end faces of the unidirectionally oriented rod-shaped elements are square, triangular, round, oval or polygonal.

3. The platform of claim 1, wherein the individual drive of each unidirectionally oriented rod-shaped element is hydraulic, pneumatic, mechanical or electromechanical.

4. The platform of claim 1, wherein side walls of the unidirectionally oriented rod-shaped elements include LED displays.

5. The platform of claim 1, further comprising a computer-assisted drive control for the independent telescoping linear movement of the unidirectionally oriented rod-shaped elements so as to shape the platform into the multiple tiers.

6. The platform of claim 1, wherein at least some of the unidirectionally oriented rod-shaped elements include joints for inclining an upper portion of each of the at least some of the unidirectionally oriented rod-shaped elements relative to the horizon.

7. The platform of claim 1, wherein the unidirectionally oriented rod-shaped elements are mounted in a frame that supports the unidirectionally oriented rod-shaped elements and forms guiding rails that enable the unidirectionally oriented rod-shaped elements to move.

8. The platform of claim 1, wherein the unidirectionally oriented rod-shaped elements have a square cross-section.

9. The platform of claim 1, wherein the unidirectionally oriented rod-shaped elements have a circular cross-section.

10. The platform of claim 1, wherein the unidirectionally oriented rod-shaped elements have a hexagonal cross-section.

11. The platform of claim 1, wherein the unidirectionally oriented rod-shaped elements are hollow inside.

12. The platform of claim 1, wherein the end faces of the unidirectionally oriented rod-shaped elements include LED displays.

13. A transformable platform for creation of three-dimensional multi-functional installations, comprising:

a plurality of rod-shaped elements arranged into at least four cells, wherein each rod-shaped element belongs to only one cell, and wherein each cell includes multiple adjacent rod-shaped elements, and wherein all the rod-shaped elements are oriented in the same direction;

each rod-shaped element having an end face;

wherein the cells form a flat horizontal or vertical surface or a surface angled relative to a horizon, in their initial position due to the end faces located at the same level, and wherein each rod-shaped element includes an individual drive for independent telescoping linear movement so as to extend or contract each rod-shaped element independent of other rod-shaped elements and to shape the platform into multiple tiers, and wherein the cells are arranged into multiple tiers, such that each tier is formed of multiple cells, with each cell belonging to only one tier, each tier having end faces of its rod-shaped elements at the same level, and different tiers having end faces of their rod-shaped elements located at different levels.

14. The platform of claim 13, wherein the end faces of the rod-shaped elements are square, triangular, round, oval or polygonal.

15. The platform of claim 13, wherein the individual drive of each rod-shaped element is hydraulic, pneumatic, mechanical or electromechanical.

16. The platform of claim 13, wherein at least some of the rod-shaped elements include joints for inclining an upper portion of each of the at least some of the rod-shaped elements relative to the horizon.

17. A transformable platform for creation of three-dimensional multi-functional installations, comprising:

a plurality of rod-shaped elements arranged into at least four cells, wherein each rod-shaped element belongs to only one cell, wherein each cell includes multiple adjacent rod-shaped elements, and wherein all the rod-shaped elements are oriented in the same direction;

each rod-shaped element having an end face, and each rod-shaped element having its vertical surfaces in a form of a telescoping sleeve-within-a-sleeve;

wherein the cells form a flat surface in their initial position due to the end faces located at the same level; and wherein each rod-shaped element includes an individual drive for independent telescoping linear movement of the sleeve-within-a-sleeve so as to extend or contract each rod-shaped element independent of other rod-shaped elements; and wherein the cells are arranged into multiple tiers, each having a tier top surface located at a different tier top surface level.

* * * * *